United States Patent [19]

Kubo et al.

[11] 3,992,557

[45] Nov. 16, 1976

[54] IMAGE TRANSFER METHOD

[75] Inventors: Shunichi Kubo, Tokyo; Takao Aoki, Abiko; Eiichi Kondo, Kawasaki; Shunzo Inoue, Fussa, all of Japan

[73] Assignee: Canon Kabushiki Kaisha, Tokyo, Japan

[22] Filed: July 17, 1974

[21] Appl. No.: 489,087

[52] U.S. Cl. ..... 427/24; 96/1.4

[51] Int. Cl.[2] ..... G03G 13/00

[58] Field of Search ..... 117/17.5; 96/1.4; 427/20, 24

[56] References Cited

UNITED STATES PATENTS

| | | | |
|---|---|---|---|
| 3,124,457 | 3/1964 | Schwertz | 96/1.4 |
| 3,615,398 | 10/1971 | Caldwell | 96/1.4 |
| 3,640,707 | 2/1972 | Caldwell | 96/1.4 |
| 3,784,300 | 1/1974 | Hudson et al. | 96/1 |
| 3,811,914 | 5/1974 | Saito et al. | 96/1.4 |

*Primary Examiner*—Bernard D. Pianalto

*Attorney, Agent, or Firm*—Fitzpatrick, Cella, Harper & Scinto

[57] ABSTRACT

In transferring a toner image carried on a toner image carrier onto a transfer medium, a uniform charge is imparted to the surface of the toner image carrier while a charge of the same polarity as the uniform charge is imparted to the surface of the transfer medium, whereafter a toner image is transferred from the surface of the toner image carrier to the surface of the transfer medium.

6 Claims, 4 Drawing Figures

IMAGE TRANSFER METHOD

BACKGROUND OF THE INVENTION

1. Field of the Invention

This invention relates to a method and device for transferring a toner image carried on an image carrier onto a transfer medium, and more particularly to such a method which may achieve good image transfer and prevent deposition of toner particles onto a photosensitive medium as well as ensures good registration.

2. Description of the Prior Art

In order to transfer a toner image resulting from development of an electrostatic latent image formed on a photosensitive medium to a transfer medium, it has usually been the practice to use a roller or like means urged into contact with the back side of the transfer medium, or to use a bias transfer method wherein a voltage is applied to such roller, or a corona transfer wherein a high voltage is applied from a corona discharger or the like to the back side of the transfer medium. In these cases, the toner image carrier, such as a photosensitive medium or the like, electrostatically attracts thereto the transfer medium and therefore, after the image transfer, it has been necessary that the transfer medium be separated from the image carrier mechanically as by a separator pawl or fluidly as by a pressurized air stream.

There is also a system whereby the surface of a transfer roller having an insulating layer is charged to electrostatically attract a transfer medium. Such system is simple in that the image transfer can be achieved by the charging, but this again requires similar means for separating the transfer medium from the roller after the image transfer has been effected.

A mechanism for effecting such operation is shown in FIGS. 1 and 2 of the accompanying drawings. A toner image 2 formed on a photosensitive drum 1 is moved to a transfer roller 5 so that the image may be transferred onto a sheet of transfer paper P which is charged by a corona discharger 4 with the polarity opposite to that of the toner. The transfer roller 5 comprises a metal roller 7 covered with an insulating coating 6. In the transfer paper, polarization of the charge is induced by the negative charge on the insulating layer 6. By a positive charge resulting from such polarization and by the field of the negative charge on the insulating layer, the transfer paper is prevented from shifting onto the drum. At the same time, toner is transferred onto the transfer paper by a field formed between the charge on the insulating layer and the toner. However, such construction has been inconvenient in that separation of the transfer paper is more difficult.

Further, in color representation wherein different toner images are transferred onto a transfer medium in superposed relationship, there is required not only the transfer efficiency but also accurate positioning of the transfer medium and prevention of once transferred toner from being re-transferred (offset).

In such color representation, therefore, use has heretofore been made of a transfer drum provided with holding grips or like mechanical means for positively holding the transfer medium. However, the use of a mechanism holding the transfer medium only in an end portion thereof has permitted the transfer medium to be gradually misaligned during repeated image transfer.

SUMMARY OF THE INVENTION

It is an object of the present invention to provide an image transfer method and device which may achieve good separation of a transfer medium from a photosensitive medium.

It is another object of the present invention to provide an image transfer method and device which may prevent misalignment of the transfer medium to thereby ensure good image transfer.

It is still another object of the present invention to provide an image transfer method and device which may eliminate offset of the transferred visual image once it has been transferred to the photosensitive medium and is thus suitable for the multi-color superposition transfer.

It is yet another object of the present invention to provide an image transfer device which can adequately hold and convey the transfer medium.

Generally, the present invention comprises the steps of uniformly charging the surface of a toner image carrier while imparting a charge of the same polarity as said charge to the surface of a transfer medium on a support member therefor, thereby transferring a toner image carried on the toner image carrier onto the transfer medium.

Other objects and features of the present invention will become apparent from an understanding of the above-described objects and features of specific embodiments which will hereinafter be described in conjunction with the accompanying drawings.

DESCRIPTION OF THE PREFERRED EMBODIMENTS

Figure 1:
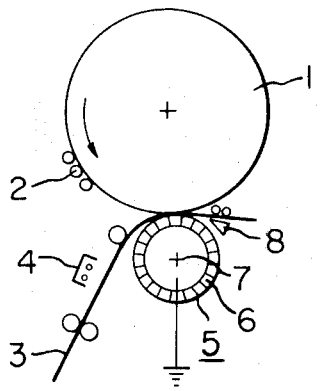
FIGS. 1 and 2 schematically illustrate the prior art image transfer technique, over which the present invention constitutes an improvement.
Figure 2:
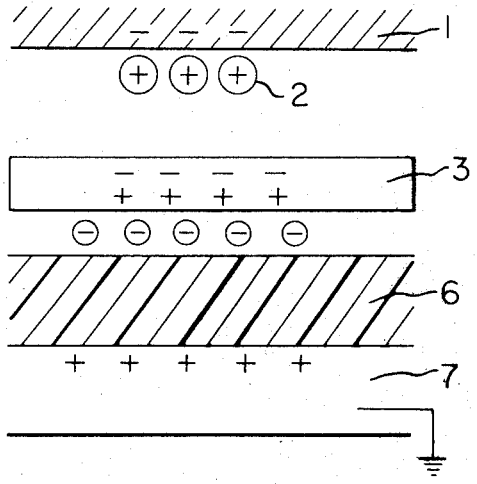
Figure 3:
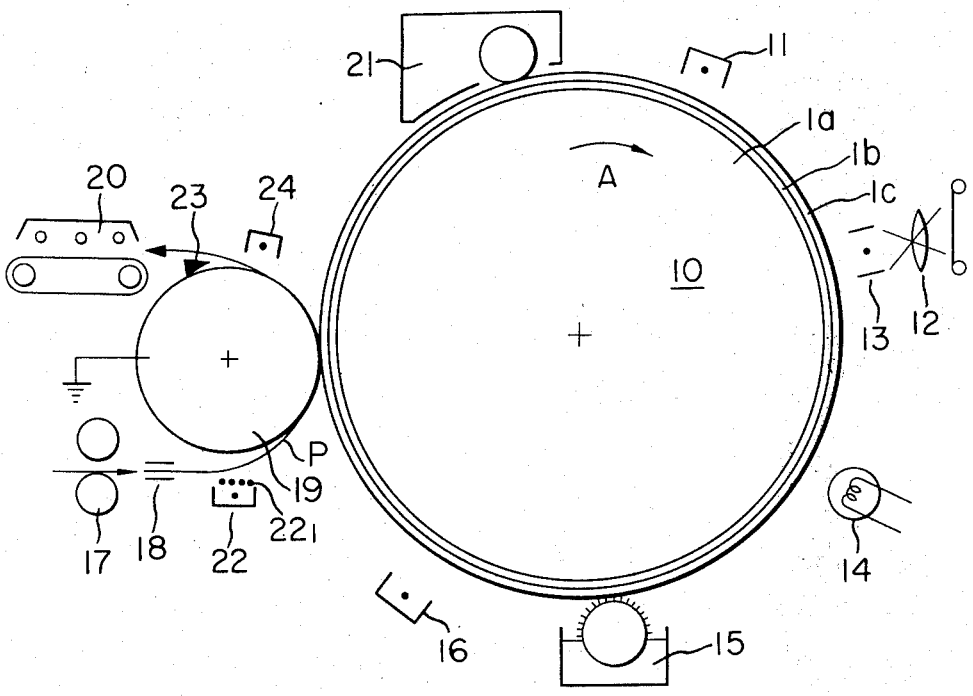
FIG. 3 schematically illustrates an embodiment of the present invention.

FIGS. 1 and 2 are described above with respect to the description of the prior art. Referring now to FIG. 3, there is shown an embodiment of the image transfer device according to the present invention as applied in an electrophotographic copying apparatus. The apparatus is of the type, which is, operable with an electrophotographic method as disclosed in, for example, U.S. Pat. No. 3,666,363 issued to H. Tanaka et al May 30, 1972 and filed Feb. 18, 1971 (CA of Ser. No. 571,538, filed Aug. 10, 1966, now abandoned). In FIG. 3, an electrophotographic sensitive drum 10 basically comprises a conductive back-up layer 1*a*, a photoconductive layer 1*b* and an insulating layer 1*c*, and is rotatable about its own axis in the direction of arrow A. The surface of the photosensitive drum 10 is first charged uniformly by a primary charger 11, whereafter it is subjected to the application of image light through a projection lens 12 and, simultaneously therewith, to a secondary charge of the opposite polarity to that of the primary charge or an AC corona discharge from corona discharge exposure means 13. Then the drum surface, if required, may be subjected to an overall exposure by overall exposure means 14, whereby an electrostatic latent image may be formed on the surface of the photosensitive drum. Such an electrostatic latent image may be developed into a visible image by developing means of the dry or the wet type. After development, the surface potential of the photosensitive drum is adjusted by a pre-transfer charging corona discharger 16, whereafter the developed image on the surface of the photosensitive drum is transferred onto a transfer medium P, which is conveyed by transfer medium conveyor rollers 17 and guide plate 18, with the aid of a transfer roller 19, and then the transfer medium with the image transferred thereto is passed for fixing through fixing means 20, thus providing a complete copy. On the other hand, the photosensitive drum, after the image transfer, is cleaned by cleaning means 21 for reuse. The image transfer station will more particularly be described hereinafter.

On the surface of the photosensitive drum 10, a negative toner image is formed through the steps of charging, exposure and development. On the other hand, a sheet of transfer medium such as transfer paper P is fed to the conductive roller 19 by the feed rollers 17. A corona discharger 22 imparts corona charge of the negative polarity to the surface of the transfer paper P which comes into contact with the drum to charge that surface negatively. At the same time, charge of the opposite polarity is induced on transfer roller 19 so tht the transfer paper P is electrostatically attracted to the transfer roller 19. The transfer roller may most suitably be formed on metal or like conductive material. Of course, conductive rubber may also be used to form the transfer roller. Preferably, the value of the resistivity of the material for the transfer roller is $10^6$ Ω cm or lower.

On the other hand, a higher resistance value of the transfer medium will result in a higher intensity of attraction.

For example, ordinary paper of high quality may be used in an environment of 40% R.H. or less, but where this level is exceeded, it will be difficult to charge such paper and provide a good attraction. It will therefore be suitable to coat or impregnate the paper with a material of high resistance such as resin or the like.

Prior to the image transfer, the surface of the photosensitive drum 10 is negatively charged by the charger 16. As a result, the transfer paper and the surface of the photosensitive drum repulse each other so that the transfer paper comes into intimate contact with the transfer roller.

The adherence of the transfer paper to the transfer roller takes place with charge being induced on the transfer drum by the charge on the transfer paper. Therefore, a layer of semiconductor may be provided on the transfer roller in order that the charge resulting from a transfer bias may be prevented from short-circuiting into the back-up member of the photosensitive medium to form pin-holes in the photosensitive medium. However, too high a resistance of the semiconductor layer would be inconvenient because it would cause the roller surface to be charged by the corona discharge during the contact of the attracted transfer paper, thus interfering with the image transfer.

Figure 4:
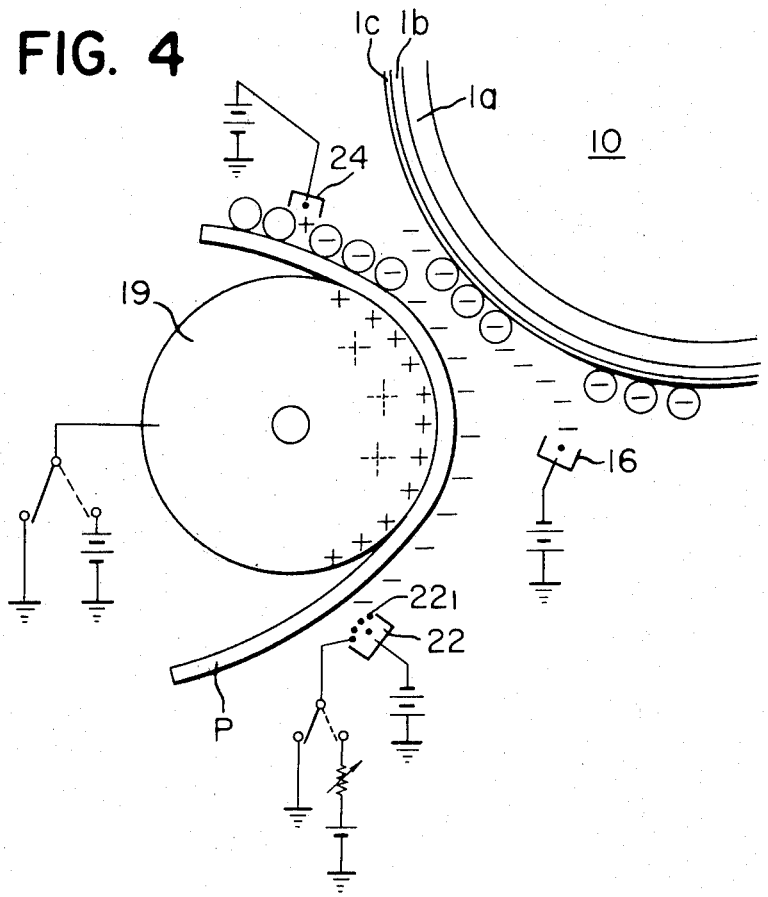
FIG. 4 illustrates the principle of image transfer according to the present invention.

FIG. 4 illustrates the manner in which the transfer paper is attracted and the charge for image transfer is provided.

The potential to which the surface of the photosensitive medium is charged prior to image transfer should preferably be higher than the potential to which the surface of the transfer medium is charged. By so setting, the toner on the surface of the photosensitive medium will be attracted either by the charge of the opposite polarity induced on the transfer roller or by the charge resulting from a voltage applied to the roller, whereby good image transfer will occur.

For this purpose, a control grid $\mathbf{22_1}$ may be preferably be disposed in front of the transfer medium attraction corona discharger 22 to control the latter.

The transfer medium with the toner image so transferred thereto is then separated from the transfer roller and conveyed to the fixing station 20. The separation can be mechanically effected by a mechanical separator pawl 23 or, if required, with the aid of a corona discharger 24 which applies an AC voltage or a voltage of the opposite polarity (for example, positive) to the charge on the paper to neutralize the charge on the paper P as illustrated in FIG. 4.

The effectiveness of the above-described image transfer method will be evident in multi-color superposition transfer. Transfer of a multi-colored image will hereinafter be described in particular.

When toner images corresponding to a plurality of resolved color images are successively transferred to a common transfer medium, as previously described, there are problems which would not be encountered in the production of monochromatic copies.

For example, a first problem is that misregistration will occur between the colors of a final copy unless the transfer medium is exactly fixed to the transfer medium carrier such as the transfer drum or the like. A second problem is that, if a second transfer occured with a first transferred toner image remaining unfixed, the toner on the transfer medium might be transferred back (offset) to the photosensitive medium.

As to the first problem, it was conventional to set the paper on the roller as by set grips but this resulted in misalignment of the paper during repeated image transfer, thus failing to provide a perfect register between colors. (A misregister exceeding 0.1 mm could not result in a satisfactory registration between the colors of the final copy). Such problems may be overcome by the present invention, since according to the invention, the transfer medium is generally attracted to the transfer roller to sufficiently prevent misalignment of the paper and this is done without using any grips or like means, thus succeeding to provide an image over the entire surface area of the transfer medium.

It has already been noted that the transfer medium is charged to keep it attracted to the transfer drum. The potential to which the transfer medium is charged is of the order of 50 to 1000 volts. However, such potential is gradually attenuated after the corona charging, and the potential drop occurring as the transfer step is repeated three or four times, as in the color copying, might reduce the efficiency with which the transfer medium is attracted to the transfer drum. In view of this, it would be effective to make such a design that the attracting potential may be maintained by corona discharge effected at every transfer step or at every second or third transfer step. Moreover, if the potential thus additionally imparted is gradually decreased, the attracting potential on the surface of the transfer drum may be well maintained at a constant level.

As to the second problem mentioned above, if, for example, the corona discharge for attracting the transfer medium and the corona discharge for charging the photosensitive medium prior to image transfer were opposite in polarity, a previously transferred image on the transfer medium would again be offset to the photosensitive medium. This is probably because the toner particles are charged into the opposite polarity under the influence of the corona discharge used to charge the transfer medium.

According to the method of the present invention, the photosensitive medium is charged prior to image transfer and this readily prevents the occurrence of offset.

It is particularly effective to charge the photosensitive medium with the same polarity as that of the toner by applying corona discharge or voltage prior to image transfer. The toner image thus transferred to the transfer medium may be repulsed by the charge of the same polarity on the photosensitive medium and thus, the possibility of offset may be eliminated.

Moreover, image transfer may be accomplished well in accordance with the difference between the surface potential of the photosensitive medium and the surface potential of the transfer medium, as already noted. In addition, these surface potentials may be well controlled each time the image transfer is repeated.

In order that the effect of the inventive method may be better understood, some examples of the present invention will be shown below.

EXAMPLE 1

A photosensitive medium comprising a ZnO layer formed over an aluminum substrate was fixed to a drum. A voltage was applied to the photosensitive medium to charge the surface thereof to a level of −500 volts, and image light was applied thereto. Development was effected by the use of positively charged toner, whereafter positive charging was effective prior to image transfer to uniformly provide a level of +500 volts. The formed image was transferred to paper of high quality which was electrostatically attracted to a roller of aluminum at +6 kilovolts. The surface potential of the paper was +200 volts. Each image to be transferred was developed with a toner of different color, and the image transfer was effected with a transfer voltage of −1000 volts applied to the aluminum roller. The image transfer was good without the occurrence of offset to the photosensitive medium. Also, the transfer paper was sufficiently attracted and the resultant copy was excellent in registration.

EXAMPLE 2

A latent image was obtained by using a photosensitive medium having a photoconductive layer formed of CdS and constructed as shown in FIG. 3. In the imaging process, also illustrated in FIG. 3, the latent image was developed by the use of negatively charge toner, and then charged to −1 kilovolt by the pre-transfer corona charger. On the other hand, paper of high quality coated with resin was attracted to a transfer roller, which was an alumite-treated aluminum roller, through corona charging of −5.5 kilovolts.

The surface of the paper was charged to −500 volts. On the other hand, an +800 volt transfer bias was applied to the transfer roller. Each image to be transferred was developed with a toner of different color, with a result that the image transfer was good without the occurrence of offset to the photosensitive medium. Again, the transfer paper was sufficiently attracted and the resultant copy was excellent in registration.

It will thus be appreciated that the present invention prevents misregistration during image transfer and also eliminates the occurrence of offset. Further, the invention ensures easy separation of the transfer medium from the transfer roller.

Furthermore, the invention may be very effectively utilized in color representation to readily provide colored copies excellent in registration and good in color balance.

We claim:

1. An image transfer method for transferring a toner image from a surface of a toner image carrier onto a transfer medium, comprising the steps of:

forming a toner image on said toner image carrier;

imparting a uniform charge of predetermined polarity to the surface of said toner image carrier carrying said toner image;

imparting a first uniform charge of the same said polarity to one surface of said transfer medium;

contacting said one surface of said transfer medium to said surface of the toner image carrier after imparting said charge to said transfer medium, and simultaneously maintaining the opposed surface of said transfer medium at a predetermined voltage during said contact, thereby transferring the toner image from said surface of said toner image carrier to said one surface of said transfer medium; and subsequently separating the transfer medium from the image carrier.

2. An image transfer method according to claim 1, wherein the charge potential imparted to said surface of said transfer medium is set to a level below the charge potential on said surface of said toner image carrier.

3. An image transfer method according to claim 1, further comprising the step of imparting a charge to said transfer medium after image transfer, wherein said second charge has a polarity opposite to said first charge.

4. An image transfer method for transferring toner images successively formed on a toner image carrier onto a surface of a transfer medium in superposed relationship, comprising the steps of forming a color resolved toner image on the toner image carrier; imparting a uniform charge to the surface of said toner image carrier bearing said toner image; imparting a charge of the same polarity as that of said uniform charge to the surface of said transfer medium; contacting said transfer medium to said surface of the toner image carrier after imparting said charge to said transfer medium thereby transferring the toner image from said carrier to said transfer medium; and successively repeating a sequence of steps including forming a color resolved toner image on the toner image carrier, wherein each image is developed with a different color toner, imparting a uniform charge to the surface of the toner image carrier, and contacting said transfer medium to said surface of the toner image carrier, thereby transferring the successive different color images to the transfer medium.

5. An image transfer method according to claim 4, wherein the charge potential imparted to said surface of said transfer medium is set to a level below the charge potential on said surface of said toner image carrier.

6. An image transfer method according to claim 4, wherein subsequent to the first image transfer but prior to the transfer of each of the other toner images, a charge of said same polarity is imparted to said surface of said transfer medium to a potential below the potential of the immediately previous charge.

* * * * *